US005236383A

United States Patent [19]

Connelly

[11] Patent Number: 5,236,383

[45] Date of Patent: Aug. 17, 1993

[54] ILLUMINATED TOY BALL

[75] Inventor: Keith Connelly, Ithaca, N.Y.

[73] Assignee: I & K Trading Corporation, Vienna, Va.

[21] Appl. No.: 800,179

[22] Filed: Nov. 27, 1991

[51] Int. Cl.[5] ..... A63H 33/22; A63H 33/26; A63B 43/06

[52] U.S. Cl. ..... 446/219; 446/397; 446/485; 273/58 G; 273/58 C

[58] Field of Search ..... 273/58 C, 58 E, 58 F, 273/58 G, 58 H; 446/242, 485, 397, 219

[56] References Cited

U.S. PATENT DOCUMENTS

| | | | |
|---|---|---|---|
| 700,850 | 5/1902 | Stone | 273/58 E |
| 2,849,819 | 9/1958 | Murphy et al. | 273/58 E |
| 3,351,347 | 11/1967 | Smith et al. | 273/58 G X |
| 3,580,575 | 5/1971 | Speeth | 273/58 G |
| 4,561,661 | 12/1985 | Walker et al. | 273/58 C X |
| 4,563,160 | 1/1986 | Lee | 446/485 X |
| 4,568,303 | 2/1986 | Brown | 446/242 |
| 4,586,456 | 5/1986 | Forward | 446/485 X |
| 4,595,200 | 6/1986 | Shishido | 273/58 G |
| 4,801,141 | 1/1989 | Rumsey | 273/58 E |
| 5,066,011 | 11/1991 | Dykstra et al. | 273/58 G |

FOREIGN PATENT DOCUMENTS

| | | | |
|---|---|---|---|
| 778438 | 7/1957 | United Kingdom | 446/485 |

*Primary Examiner*—Mickey Yu
*Attorney, Agent, or Firm*—Blum Kaplan

[57] ABSTRACT

A toy ball of increased play value is provided and includes a sphere. A light source is disposed within the sphere. A switch disposed within the sphere activates the light source when the ball is impacted such as when it is bounced.

18 Claims, 4 Drawing Sheets

FIG. 3
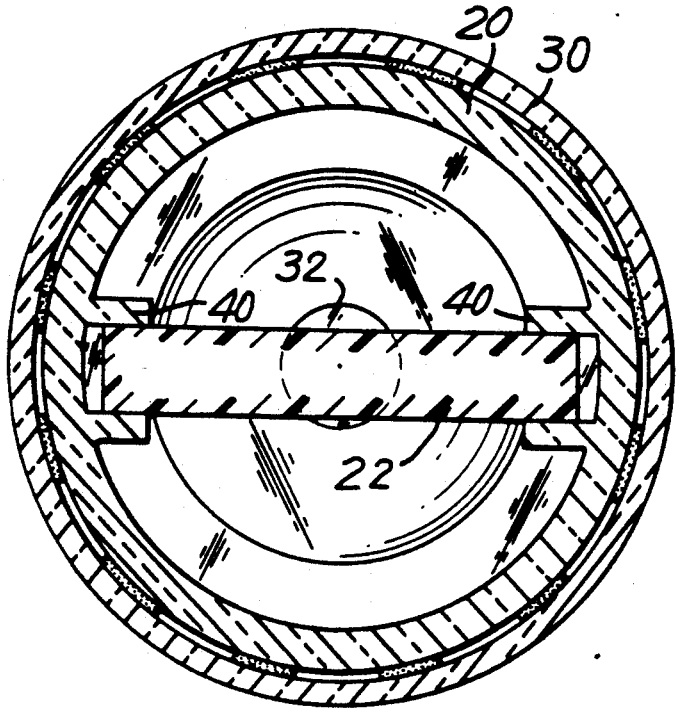
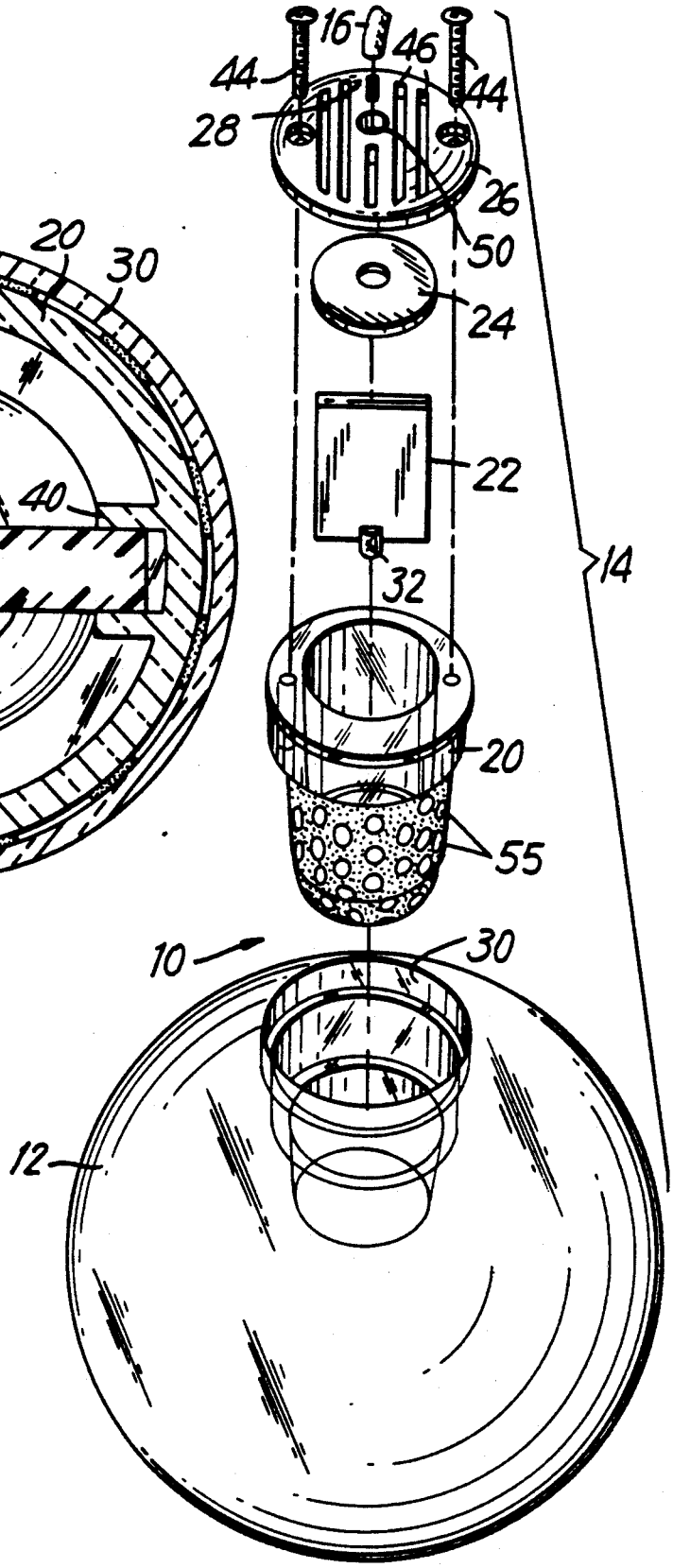
FIG. 4

ILLUMINATED TOY BALL

BACKGROUND OF THE INVENTION

The present invention is generally directed to a toy ball, and in particular to a toy ball which reacts to being bounced by emitting a light or a sound.

Toy balls are well known in the art and are one of the most basic toys for children. Balls have come in varying sizes with varying appearances for hundreds of years. Generally, balls are spherical and are either hollow or solid and formed of materials which allows resilient plastic deformation resulting in a bouncing ball. Henceforth, it has been believed that the physical action of the ball was sufficient to capture a child's attention. However, after a low number of repetitions bouncing a ball becomes tedious, resulting in dissipation of the child's interest. Accordingly, a toy ball which provides increased play value is desired

SUMMARY OF THE INVENTION

Generally speaking, in accordance with the instant invention, a toy ball includes a translucent sphere. A light source is disposed within the sphere. A motion switch is coupled to the light source and is mounted within the sphere for turning the light source on in response to the sphere impacting on an object.

In a preferred embodiment, a sound source is also coupled to the motion switch so that a sound is caused to be generated simultaneously with the light. Additionally, a housing is provided for the light source, the housing being transparent and having an opaque pattern formed on portions thereon causing the pattern to be projected on the interior of the sphere.

Accordingly, it is an object of the instant invention to provide an improved toy ball.

A further object of the instant invention is to provide a toy ball with an increased play value.

Another object of the instant invention is to provide a toy ball which encourages play over an extended period of time.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 3 is a sectional view taken along lines 3—3 of FIG. 2;

FIG. 4 is an exploded perspective view of a toy ball constructed in accordance with the invention;

DESCRIPTION OF THE PREFERRED EMBODIMENTS

Figure 1:
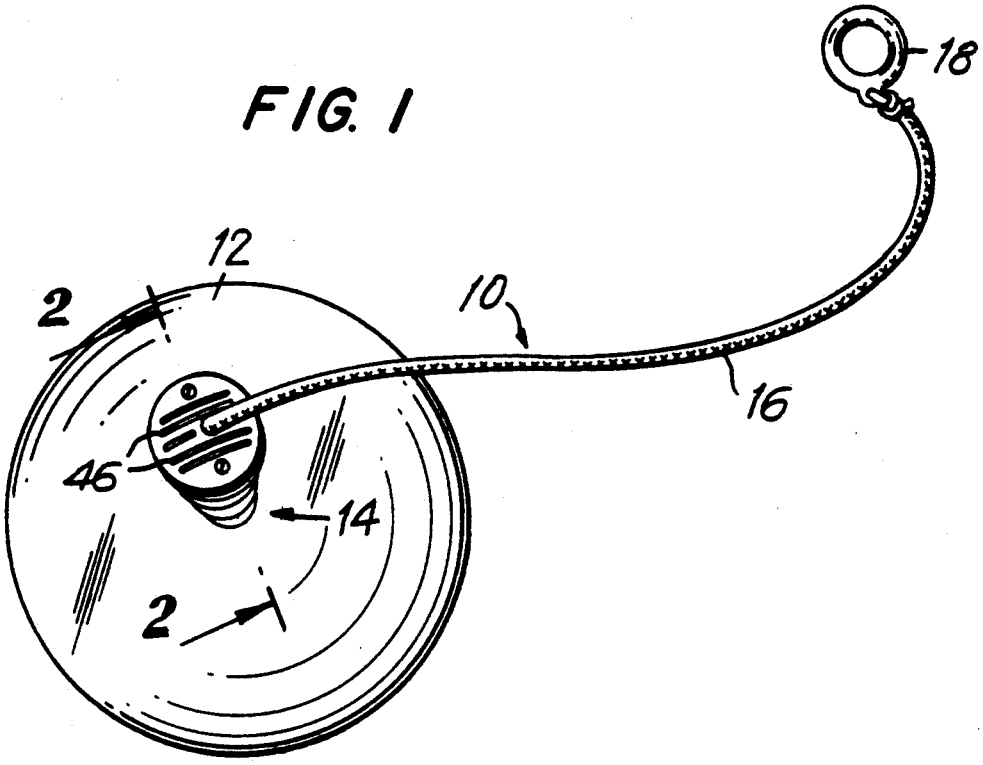
FIG. 1 is a perspective view of a toy ball constructed in accordance with a first embodiment of the invention.

Reference is first made to FIGS. 1–4, wherein an illuminated toy ball, generally indicated as 10, constructed in accordance with the instant invention is depicted. Illuminated ball 10 includes a translucent sphere 12. A plug assembly 14 is fixedly disposed in sphere 12. A cord 16 couples a ring 18 to plug assembly 14.

In an exemplary embodiment, sphere 12 is hollow and is formed with side walls 30 forming a channel therein at one portion. Plug assembly 14 is disposed within the channel formed by side walls 30 forming an airtight seal with sphere 12 allowing inflation of sphere 12. Plug assembly 14 may be retained in place by tension fit or by an adhesive such as glue or the like. Sphere 12 is formed of a material exhibiting resilient elastic deformation causing sphere 12 to bounce upon impact with a solid object such as a wall, a floor or the hand of the user. Although not necessary for operation, in an exemplary embodiment, cord 16 is provided and is formed of an elastic material so that when sphere 12 is forced away from ring 18, elastic cord 16 will stretch and then contract returning sphere 12 toward rings 18.

Figure 7:
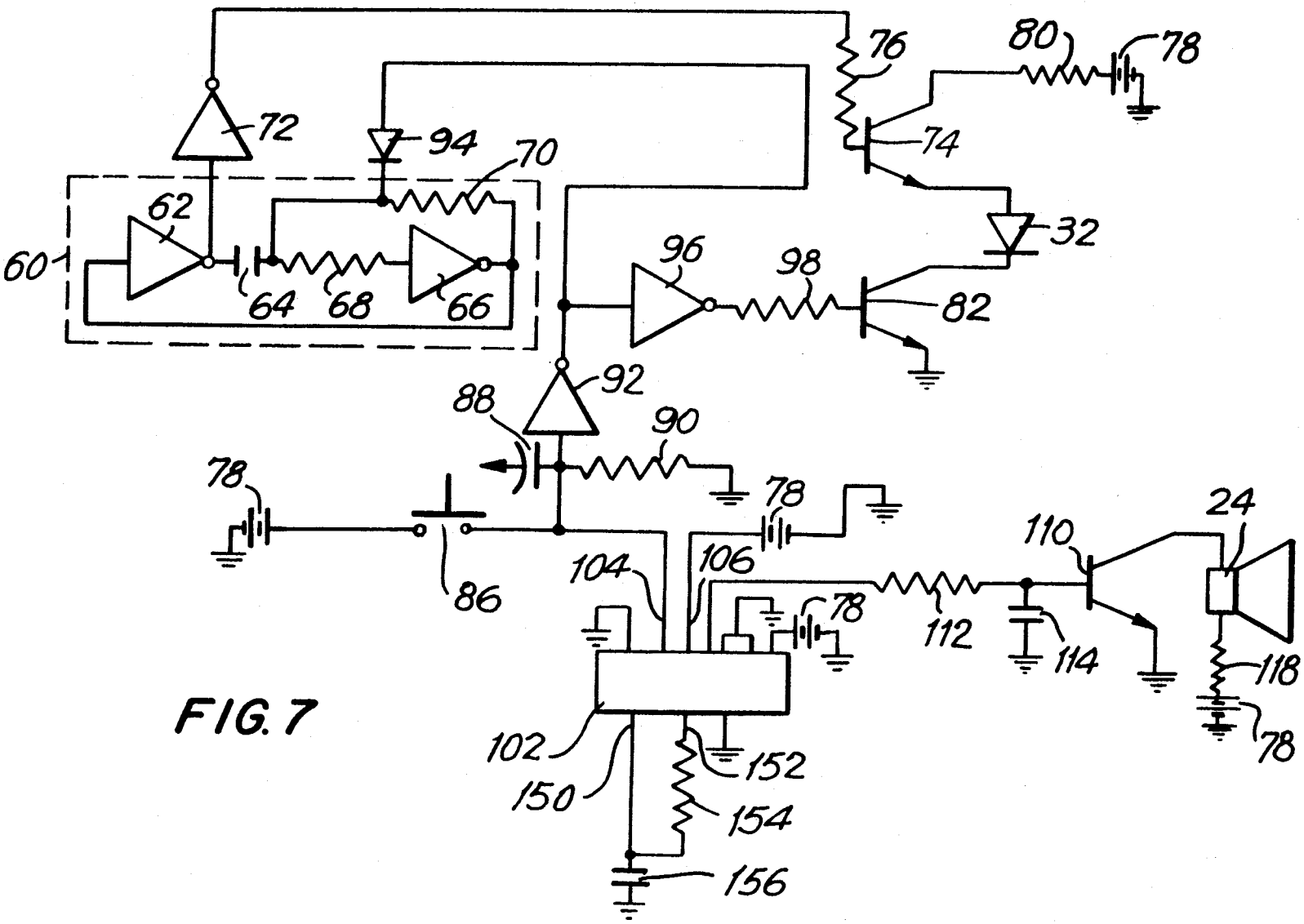
FIG. 7 is a circuit diagram of the light illuminating-/sound generating circuit utilized in connection with the toy ball constructed in accordance with the invention.

Plug assembly 14 includes a housing 20 formed of a transparent material. Housing 20 is received by the channel formed by side walls 30. As seen, in an exemplary embodiment, side walls 30 may be stepped or formed in some other formation. Housing 20 is shaped to be received by side wall 30 and therefore is also formed in a stepped pattern. A printed circuit board 22 (the back of which is shown in FIGS. 3, 4 and the circuit of which is shown in FIG. 7) is disposed within housing 20. A lenseless light emitting diode (LED) 32 is mounted on printed circuit board 22 and operated by the circuitry of printed circuit board 22. A battery 78 (FIG. 7) is also mounted on printed circuit board 22 and provides power for driving LED 32 in response to a motion switch 86 (FIG. 7) also mounted on printed circuit board 22. A speaker 24 disposed within housing 20 is also coupled to the circuit of printed circuit board 22.

Figure 2:
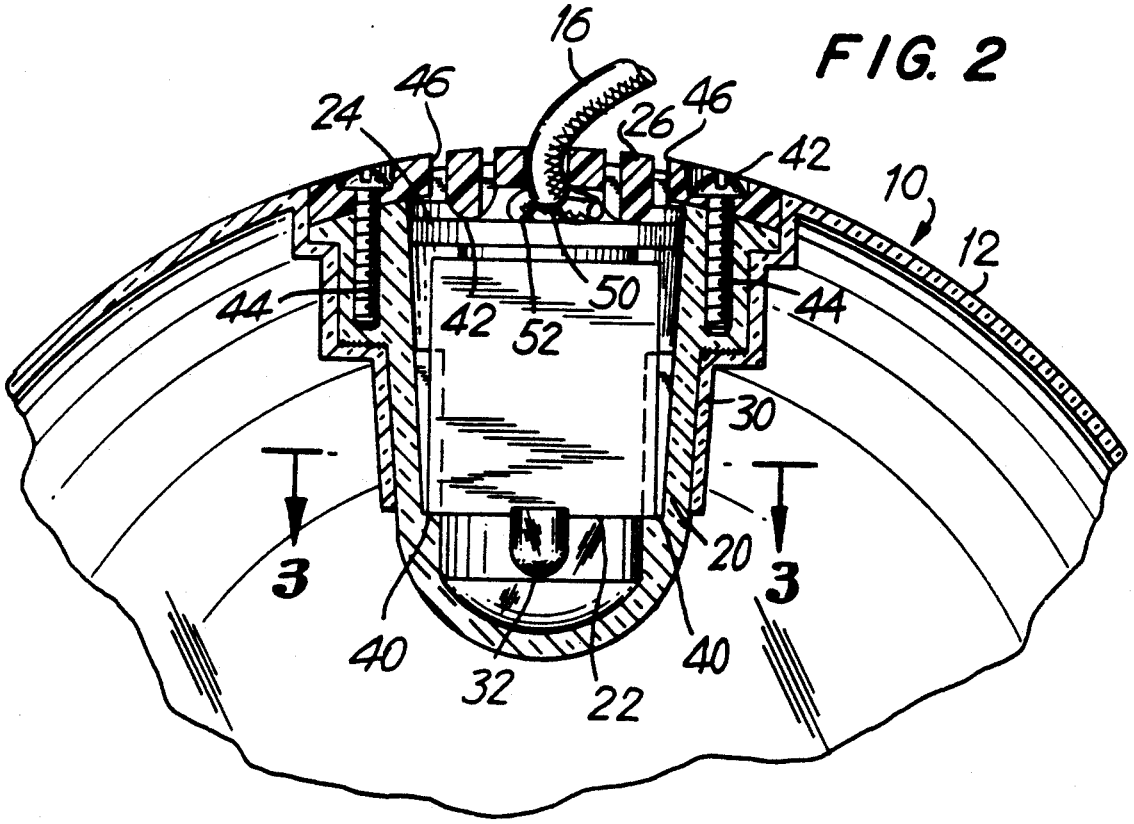
FIG. 2 is a sectional view taken along lines 2—2 of FIG. 1.

Housing 20 is formed with internal shoulders 40 (FIG. 2). Printed circuit board 22 rests on shoulders 40. Speaker 24 is disposed on printed circuit board 22. A cover 26 of plug assembly 14 is mounted at the top of housing 20 within side walls 30 flush with the surface of sphere 12. Cover 26 is formed with positioning ribs 42 which contacts speaker 24 maintaining the contents within housing 20 sealed within housing 20 and in place between shoulders 40 and ribs 42 when cover 26 is secured to housing 20 utilizing screws 44.

Cover 26 is formed with slots 46 therein allowing sound produced by speaker 24 to emit therethrough. Cover 26 is also formed with a hole 50 therein for receiving elastic cord 16. Elastic cord 15 is tied in a knot 52 at one side of cover 26 retaining elastic cord 16 within hole 50.

During operation, toy ball 10 is bounced against a solid object. Upon impact, LED 32 is illuminated for a predetermined period of time illuminating sphere 12 giving it an overall glowing effect. Simultaneously, the circuit of printed circuit board 22 causes speaker 24 to produce a noise lasting for the duration of the illumination of sphere 12. Because LED 32 is lenseless, the undirected light scatters in all directions illuminating all of sphere 12. In an exemplary embodiment, an opaque pattern such as dots 55, stars or the like are provided on housing 20. When LED 32 is illuminated, it causes the pattern to be projected upon the inner surface of sphere 12 so that the pattern appears to the user when toy ball 10 is bounced.

Reference is now made to FIG. 7 wherein the circuit of printed circuit board 22 which drives speaker 24 and LED 32 is provided. An a stable clock 60 includes a first inverter 62 which provides an output to a capacitor 64. Capacitor 64 is coupled to a second inverter 66 through a resistor 68. Capacitor 64 also provides an input to inverter 62 through a resistor 70. A feedback input is also provided to inverter 62 by inverter 66. In an exemplary embodiment, the resistance of resistor 68 is substantially ten times that of resistor 70. Resistor 68 has a resistance of 250 KΩ while resistor 70 has a resistance of 25 KΩ. Capacitor 64 has a capacitance of 0.22 μF.

Inverter 72 receives the output of inverter 62 which is a signal which oscillates at 18 Hz. Inverter 72 provides an oscillating input to the base of gating transistor 74 through a resistor 76. The collector of transistor 74 is coupled to battery 78 through a current limiting resistor 80. Battery 78 is positioned between resistor 80 and ground. LED 32 is coupled between the emitter of transistor 74 and the collector of a second transistor 82. The emitter of transistor 82 is coupled to ground. Battery 78 is also coupled through a current limiting resistor 84 to a motion switch 86. Motion switch 86 is coupled at one end to a capacitor 88 which is coupled in parallel to a resistor 90 and ground. In an exemplary embodiment, capacitor 88 has a capacitance of 0.22 μF and resistor 90 has a resistance of about 250 KΩ. Capacitor 88 provides an input to an inverter 92 which is coupled to a stable clock 60 through a diode 94 providing an input thereto which gates off astable clock 60. Inverter 92 also provides an input to inverter 96 which is coupled to the base of transistor 82 through a resistor 98.

The portion of the circuit described above causes LED 32 to light. Switch 86 is a motion switch so that when sphere 12 impacts an object switch 86 momentarily closes coupling battery 78 to capacitor 88 charging capacitor 88. After impact, switch 88 is opened and positioned for the next impact. Resistor 90 in combination with ground acts as a drain for capacitor 88. As capacitor 88 discharges, capacitor 88 provides high signal inputs to inverter 92 which outputs a low signal to diode 94 causing astable clock 60 to output an oscillating signal. Each time the output of inverter 72 is high, the current produced by resistor 80 and battery 78 passes to LED 32. Simultaneously, inverter 92 is providing a low output to inverter 96 which in turn provides a high input signal to transistor 82 completing the circuit extending from battery 78 to the ground at the emitter of transistor 82 thus illuminating LED 32 in an oscillating manner. LED 32 is illuminated and "flickers" due to the oscillating output of inverter 72 for the time period required to discharge capacitor 88. In a preferred embodiment, this time period is one or two seconds. The oscillation occurs at a rate which is slower then the persistence of vision, lending a less focused and amorphous quality to the light.

Reference is now made to the remainder of FIG. 7 which controls sound production. Sound chip 102 stores sound data at various addresses therein which may be pre-input through audio inputs during the time of manufacture. Sound chip 102 may be chip number UM 5000 manufactured by the UMC Corporation of Taiwan. Sound chip 102 receives two high signals input from leads 104 and 106. Lead 104 is coupled to capacitor 88 and to battery 78 through switch 86. Chip 102 is also grounded at four other leads.

The internal clocking of sound chip 102 is provided by the RC network of capacitor 156 and resistor 154. Capacitor 156 is connected between ground and lead 150 of sound chip 102. Capacitor 156 is also connected to lead 152 of sound chip 102 through resistor 154. Resistor 154 is preferably approximately 680 KΩ and capacitor 156 is preferably approximately 6800 pF. This combination maintains operation of sound for the same period of time as LED 32 is illuminated for. A transistor 110 is coupled to chip 102 through an RC circuit formed by a resistor 112 and a capacitor 114. The collector of transistor 110 is coupled to speaker 24 which in turn is coupled in series with a current limiting resistor 118, battery 78 and ground. The emitter of transistor 110 is coupled to ground so that when transistor 110 is enabled, a current path from battery 78 through speaker 24 to ground is provided. A sound signal generated by sound chip 102 corresponding to the sound stored at the address indicated by the input at lead 104 is input to transistor 110 through the RC circuit formed by resistor 112 and capacitor 114 causing sound to be generated by speaker 116 in response to the sound signal. In an exemplary embodiment, resistor 108 has a value of 100 KΩ, capacitor 114 has a capacitance of 0.15 pf and resistor 112 has a value of between 0 and 18 Ω dependent upon the desired volume.

During operation, the user of toy ball 10 would insert a finger through ring 18. The ball is then thrown from the hand extending elastic cord 16 to its maximum elastic deformation. Cord 16 then contracts returning the ball to the hand of the user. The impact of returning toy ball 10 contacting the hand of the user closes motion switch 86 energizing capacitor 88. Capacitor 88 begins to drain through resistor 90 while outputting high signals to both inverter 92 and inverter 100. This drives astable clock 60 causing an oscillating signal to be input to transistor 74 opening a pathway to LED 32 in an oscillating fashion. Simultaneously, a high signal is output by inverter 96 opening the pathway of transistor 82 causing LED 32 to be illuminated i.e. to exhibit alternating ON and OFF states, with the receipt of each high signal of the oscillating signal input to transistor 74. This lighting continues for a brief period of time, one or two seconds, the time required to drain capacitor 88.

Simultaneously, a sound is generated in response to the inputs provided to sound chip 102. Sound chip 102, in response to the input at terminal 104, produces a sound signal which is output through the RC circuit providing a high signal to transistor 110 opening a pathway through speaker 24 causing speaker 24 to emit a sound simultaneously with the lighting of LED 32. Because the time duration is short, two seconds or less, the light and sound are extinguished prior to the return of the ball to its starting point. This encourages the user to bounce the ball again in order to make toy ball 10 light and make a sound.

Motion switch 86 would also be caused to close if the ball were thrown against a solid object such as the floor, a wall or another person in playing a game such as dodge ball or catch. Additionally, as can be seen, the lighting circuitry and the sound generating circuitry act independently of each other so that the ball may include either a sound only feature or a light only feature depending upon a desired results. Further, the ball of toy ball 10 is shown as an exemplary embodiment. The toy will operate equally as well without elastic cord 16 so that the toy ball need only include sphere 12 and plug 14 to operate.

Figure 5:
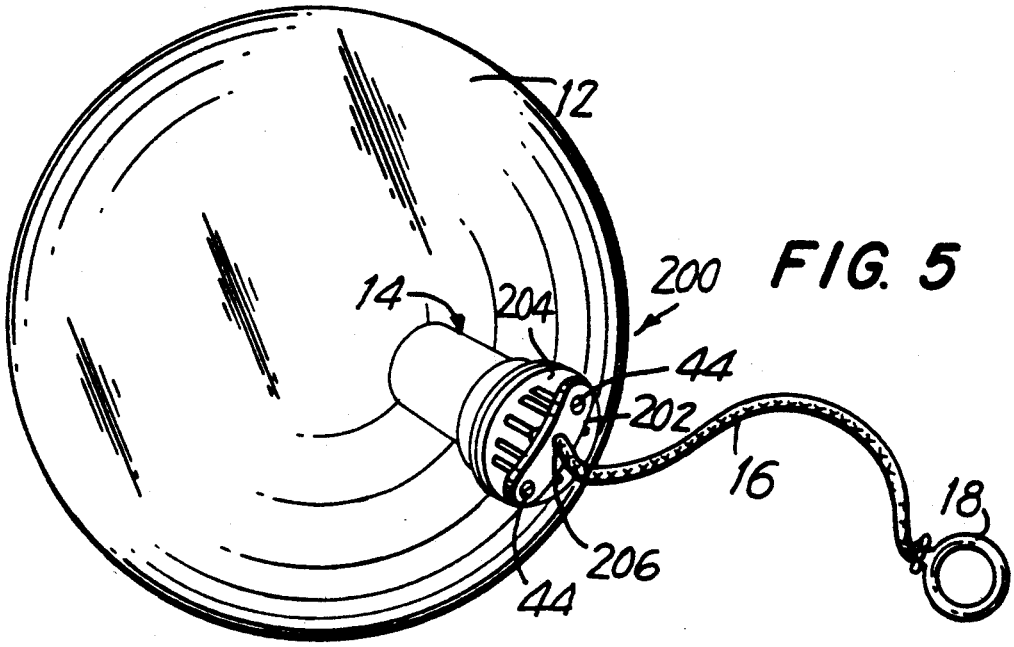
FIG. 5 is a perspective view of a toy ball constructed in accordance with a second embodiment of the invention.

Reference is now made to FIG. 5 wherein a toy ball generally indicated as 200, constructed in accordance with a second embodiment of the invention is depicted. Toy ball 200 is similar to toy ball 10, the primary difference being the inclusion of a cross bar in toy ball 200 to which elastic cord 16 is affixed. Like numerals are utilized to indicate like structures in FIG. 5.

A cross bar 202 is affixed across cover 204 utilizing screws 44. Cross bar 202 is formed with a centered hole 206 which receives elastic cord 16. Again, a knot is tied at the free end of elastic cord 16 to maintain elastic cord 16 within hole 206.

Figure 6:
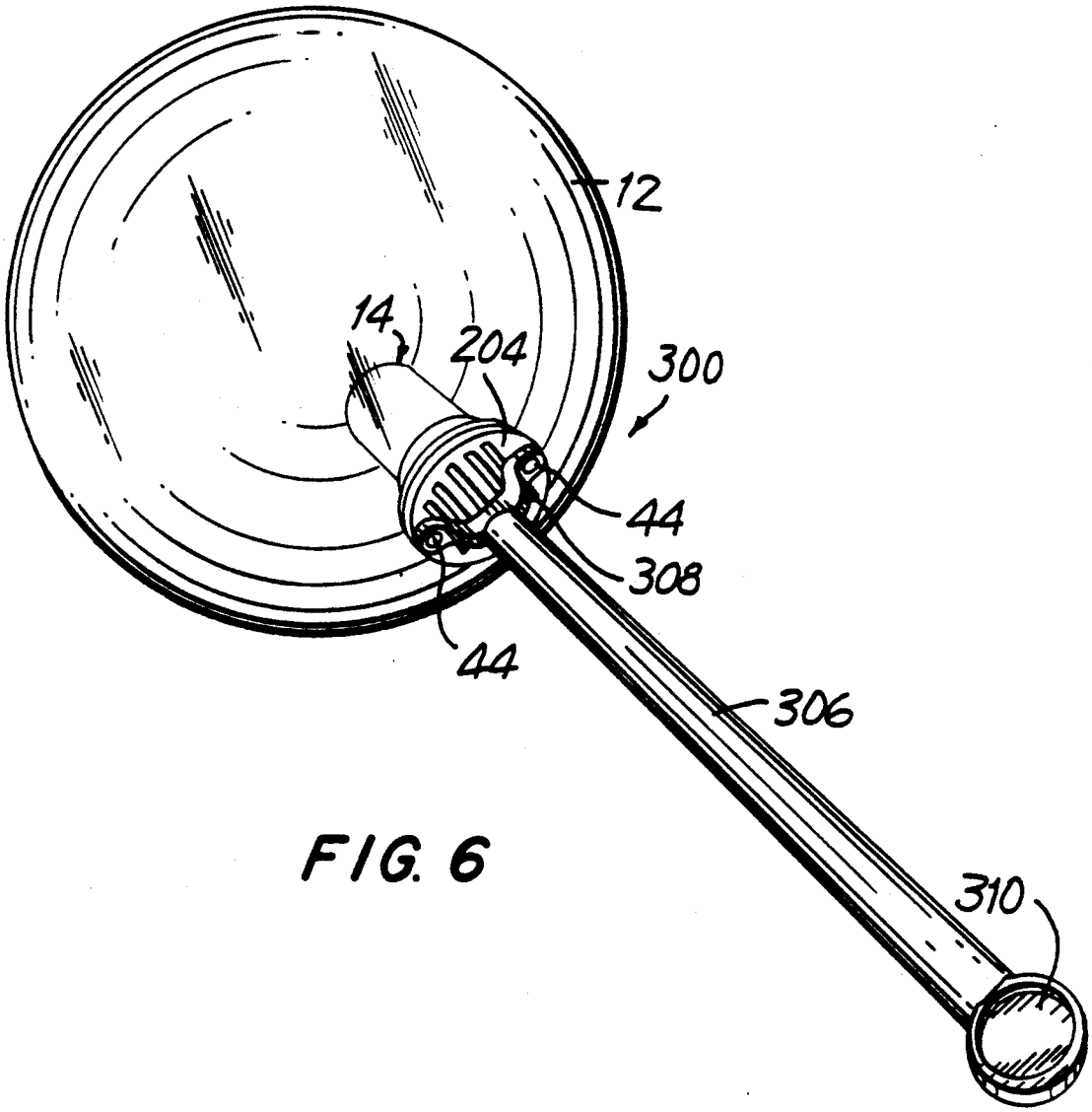
FIG. 6 is a toy ball constructed in accordance with a third embodiment of the invention.

Reference is now made to FIG. 6 wherein a toy ball generally indicated as 300, constructed in accordance with a third embodiment of the invention is depicted. Toy ball 300 is similar to toy ball 200 the primary difference being the substitution of a solid bar for the elastic cord providing an overall scepter effect. Again, like numerals are utilized to indicate like structure.

A bar 306 is integrally formed with a cross bar 308. Cross bar 308 is affixed to cover 204 utilizing the screws 44 utilized to affix cover 204 to housing 20. A decorative plate 310 suitable for imprinting or molding with an emblem or a figure is integrally formed at the other end of bar 306 providing an overall scepter appearance for toy ball 300. In such an embodiment, the user grabs toy ball 300 by the handle provided by bar 306 and strikes a solid object with sphere 12 of ball 300 causing toy ball 300 to become illuminated and to produce a sound.

By providing a toy ball having a light source and a sound source contained therein each activated by a switch upon impact with a solid object increased play value is provided by the ball. Additionally, utilizing a capacitor and drain to drive the circuit for a limited time, the user is encouraged to continue bouncing the ball to continue lighting the ball and making the sound, thus reducing the boredom factor and increasing the play time. By providing a transparent housing for the light source which includes a pattern imprinted thereon which is projected onto the sphere of the ball during use, the play value is even further enhanced.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A toy ball comprising a hollow sphere; light source means disposed within said sphere for illuminating said sphere, said light source means providing diffused light about the interior of said sphere; stitching means for selectively activating said light source means in response to said sphere receiving an impact, and light source driving means coupled between said switching means and said light source means for receiving an input from said switching means when said sphere is impacted and activating said light source means for a predetermined time period, said light source driving means oscillating said light source means between an illuminated state and a non-illuminated state during said predetermined time period, the length of said predetermined time period being independent of the input from said switching means.

2. The toy ball of claim 1, further comprising a rod affixed to said sphere.

3. The toy ball of claim 1, wherein said light source driving means includes a capacitor and drain, said light source driving means activating said light source means for a time period equal to a time period during which said capacitor drains.

4. The toy ball of claim 1, wherein said light source driving means oscillates said light source means at a rate slower than the persistence of vision.

5. The toy ball of claim 1, wherein said sphere is formed with a channel therein and further comprising plug assembly means disposed within said channel said plug assembly means including a housing for supporting said light source means, switching means and light source driving means therein.

6. The toy ball of claim 5, wherein said housing is transparenta nd further comprising an opaque pattern formed on said housing for forming images on said sphere.

7. The toy ball of claim 6, wherein said sphere is translucent.

8. The toy ball of claim 1, wherein said sphere is formed of a material which exhibits resilient elastic deformation.

9. The toy ball of claim 1, wherein said light source means is a lenseless LED.

10. The toy ball of claim 1, wherein said sphere is translucent and further comprising a transparent housing, said light source means being disposed within said housing and an opaque pattern formed on said housing for forming images on said sphere.

11. The toy ball of claim 1, further comprising an elastic cord coupled to said sphere.

12. The toy ball of claim 1, further comprising sound source means disposed within said sphere for generating sound, said switching means selectively causing said sound source means to generate a sound when said ball is impacted.

13. The toy ball of claim 12, further comprising an elastic cord coupled to said sphere.

14. The toy bal of claim 12, further comprising a rod affixed to said sphere.

15. The toy ball of claim 11, further comprising sound source driving means coupled between said switching means and said sound source means for receiving an input from said switching means when said ball is impacted and activating said sound source means for a predetermined time period.

16. A toy ball comprising a hollow sphere; light source means disposed within said sphere for illuminating said sphere, said light source means providing diffused light about the interior of said sphere; sound source means for generating a sound; switching means for selectively activating said light source means and casing said sound source means to generate a sound in response to said sphere receiving an impact; light source and sound source driving means coupled between said switching means, said sound source and and said light source means for receiving an input from said switching means in response to said ball receiving an impact and activating said light source means and said sound source means for a predetermined time period; said light source and sound source driving means including a capacitor and drain the length of said predetermined time period being independent of the input of said switching means; said sphere being translucent and said light source driving means oscillating said light source means between an illuminated state and a non-illuminated state during the predetermined time period; and further comprising a transparent housing in said sphere, said light source means being disposed in said housing; and an opaque pattern formed on said housing for forming images on said sphere.

17. The toy ball of claim 16, wherein said sphere is formed of a material which exhibits resilient elastic deformation.

18. The toy ball of claim 16, wherein said light source means includes a lenseless LED.

* * * * *